US006096487A

United States Patent [19]

Foster

[11] Patent Number: 6,096,487

[45] Date of Patent: Aug. 1, 2000

[54] CYAN DYE RECOVERY USING FERRIC AMINOPOLYCARBOXYLIC ACID BLEACHING COMPOSITION

[75] Inventor: David G. Foster, Rochester, N.Y.

[73] Assignee: Eastman Kodak Company, Rochester, N.Y.

[21] Appl. No.: 09/260,729

[22] Filed: Mar. 2, 1999

Related U.S. Application Data

[63] Continuation-in-part of application No. 08/939,628, Sep. 29, 1997, abandoned, which is a continuation-in-part of application No. 08/800,936, Feb. 13, 1997, abandoned.

[51] Int. Cl.[7] ..... G03C 7/42

[52] U.S. Cl. ..... 430/430; 430/393

[58] Field of Search ..... 430/460, 461, 430/393, 430

[56] References Cited

U.S. PATENT DOCUMENTS

| | | | |
|---|---|---|---|
| 5,460,924 | 10/1995 | Buchanan et al. | 430/393 |
| 5,521,056 | 5/1996 | Buchanan et al. | 430/430 |
| 5,582,958 | 12/1996 | Buchanan et al. | 430/461 |
| 5,627,015 | 5/1997 | Okada et al. | 430/461 |
| 5,670,305 | 9/1997 | Gordon et al. | 430/461 |
| 5,691,120 | 11/1997 | Wilson et al. | 430/461 |

FOREIGN PATENT DOCUMENTS

| | | | |
|---|---|---|---|
| 0 329 088 | 8/1989 | European Pat. Off. | G03C 7/42 |
| 0657777 | 6/1995 | European Pat. Off. . | |
| 0723194 | 7/1996 | European Pat. Off. . | |
| 0789275 | 8/1997 | European Pat. Off. . | |
| 26542 | 7/1973 | Japan . | |
| 51-007930 | 1/1976 | Japan . | |
| 53048529 | 10/1976 | Japan . | |
| 0859276 | 3/1998 | U.S. . | |

OTHER PUBLICATIONS

Japanese Abstract JP09120129, May 6, 1997.

J. Chem. Soc. Dalton Trans. 1986, p. 619. Lannon et al Redox Reactions of Some Iron(11), Iron (111), and Cobalt(111) Picolinate Complexes.

Research Disclosure 15704 Use of Persulfate Bleaching Agents in Photograp Processing.

Research Disclosure 37141 of Mar. 1995 Photographic Bleaching Composition and Processing Method Using Ternary Iron Carboxylate Complexes.

*Primary Examiner*—Hoa Van Le

*Attorney, Agent, or Firm*—J. Lanny Tucker

[57] ABSTRACT

Cyan dye density can be maximized in color developed silver halide photographic color materials and bleaching accelerated by contacting the materials with a bleaching or bleach-fixing composition comprising a mixture of a ferric complex of an aminopolycarboxylic acid as a bleaching agent, and an aromatic pyridinyl mono- or dicarboxylic acid in uncomplexed form. The molar ratio of the uncomplexed aromatic carboxylic acid to the ferric ion in the bleaching composition is from about 0.02:1 to about 0.8:1.

15 Claims, 9 Drawing Sheets

CYAN DYE RECOVERY USING FERRIC AMINOPOLYCARBOXYLIC ACID BLEACHING COMPOSITION

RELATED APPLICATIONS

This application is a Continuation-in-part of U.S. Ser. No. 08/939,628, filed Sep. 29, 1997, now abandoned, which is a Continuation-in-part of U.S. Ser. No. 08/800,936 filed Feb. 13, 1997, now abandoned.

FIELD OF THE INVENTION

The present invention relates to a photographic bleaching or bleach-fixing composition comprising ferric aminopolycarboxylic acids. It also relates to a method of bleaching or bleach-fixing in which the recovery of cyan dye density is accelerated.

BACKGROUND OF THE INVENTION

During processing of silver halide color photographic elements, the developed silver is oxidized to a silver salt by a suitable bleaching agent. The oxidized silver is then removed from the element in a "fixing" step. In some processes, the two steps can be combined in a so-called bleach-fix step.

Common bleaching agents include ferric chelate complexes of aminopolycarboxylate ligands, such as ethylenediaminetetraacetic acid (EDTA) and 1,3-propylenediaminetetraacetic acid (PDTA). These agents perform acceptably, but are not generally biodegradable, and environmental concerns are very prominent in many cultures. Other ligands have become acceptable for providing both bleaching and biodegradability, including β-alaninediacetic acid (ADA), ethylenediaminedisuccinic acid (EDDS) and methyliminodiacetic acid (MIDA).

These biodegradable bleaching agents may have one or more deficiencies, most notably a lower bleaching rate than the EDTA complexes. Thus, ferric complexes of ADA are well known, but they are relatively slow bleaching agents compared to the ferric-EDTA complexes. Thus, they must be used in higher concentrations which is undesirable for cost and environmental reasons.

Japanese Kokai 51-07930 (published Jan. 22, 1976) describes the use of nitrilotriacetic acid or 2,6-pyridinedicarboxylic acid or both to reduce stains in neutralizing or fixing solutions. Bleaching solutions containing an aminocarboxylic acid metal complex salt or a polycarboxylic acid metal complex salt are also known. Japanese Kokai 53-048529 (published May 2, 1978) describes the use of such complexes to lower fog.

EP-A-0 329 088 (published Aug. 23, 1989) describes bidentate complexes in bleaching solutions which further contain buffers, one of which is 2-pyridinecarboxylic acid (PCA). Complexes of PCA with iron are not described.

A ferric complex of 2,6-pyridinedicarboxylic acid (PDCA) is described in U.S. Pat. No. 5,460,924 (Buchanan et al). Useful ternary bleaching agents are described in copending and commonly assigned U.S. Ser. No. 08/622,236 (filed Mar. 22, 1996, by Gordon et al). Such materials comprise one iron atom complexed with two different ligands.

Japanese Kokai 50-26542 (published Mar. 19, 1975) describes bleaching solutions containing a binary iron chelate with a ligand such as 2-carboxypyridine, 8-hydroxyquinoline or 2-carboxypyrazine. However, the molar ratios of these ligands to iron are quite low as demonstrated in the examples of that publication (less than 0.1:1).

PCA and PDCA are used as one ligand in ternary ferric bleaching agents as described in U.S. Pat. No. 5,521,056 (Buchanan et al). In such complexes, the PCA or PDCA must be present at a molar ratio to ferric ion of at least 0.6:1.

Besides slower bleaching rates, another problem encountered in some bleaching processes is the undesirable formation of a colorless or "leuco" form of cyan dyes within photographic elements, especially photographic color negative films, during processing. This may be observed particularly with 1-naphthol type cyan dyes, and thus there is a need to control it, or to actually convert the colorless form back to the colored dye (known as "leuco cyan dye recovery").

There remains a need in the art for highly water-soluble bleaching solutions which preferably contain biodegradable bleaching agents, that provide rapid and effective bleaching and are compatible with bromide or chloride rehalogenation. There is also a need for a way to reduce the formation of colorless forms of cyan dye, or to promote leuco cyan dye recovery, in bleached photographic elements.

SUMMARY OF THE INVENTION

The problems noted above are overcome with a composition for bleaching or bleach-fixing an imagewise exposed and developed silver halide color photographic element that has at least one layer containing a cyan dye, the composition comprising a mixture of:

one or more ferric complexes of an aminopolycarboxylic acid that is iminodiacetic acid, nitrilotriacetic acid, propylenediaminetetraacetic acid, methyliminodiacetic acid, β-alaninediacetic acid, ethylenediaminetetraacetic acid or ethylenediamine disuccinic acid, the one or more ferric complexes being present as the sole bleaching agent or agents in an amount to provide ferric ion at from about 0.005 to about 0.5 mol/l, and the molar ratio of the aminopolycarboxylic acid to ferric ion is from about 1:1 to about 5:1, and substantially in an uncomplexed form, an aromatic carboxylic acid having either structure (I)

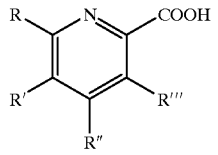

or (II)

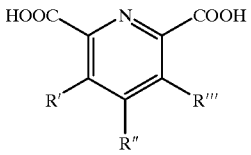

wherein R, R', R" and R"' are independently hydrogen, an alkyl group of 1 to 5 carbon atoms, an aryl group of 6 to 10 carbon atoms in the aromatic nucleus, a cycloalkyl group of 5 to 10 carbon atoms in the ring, hydroxy, nitro, sulfo, amino, phospho, carboxy, sulfamoyl, sulfonamido or halo, or any two of R, R", R"' can comprise the carbon atoms necessary to form a 5- to 7-membered ring fused with the pyridinyl nucleus, the molar ratio of the uncomplexed aromatic carboxylic acid to the ferric ion in the bleaching agent being from 0.02:1 to 0.8:1.

This invention also provides a method for using the noted composition for effective bleaching of the noted color photographic elements in an effective fashion.

Several advantages are achieved with this invention. Bleaching is accelerated in the presence of the noted aromatic carboxylic acids and specific ferric complexes as the essential components in the bleaching or bleach-fixing compositions. Moreover, it was found that accelerated leuco cyan dye recovery could be achieved with while bleaching with such compositions. The present invention can achieve a recovery of leuco cyan dye in a short time that is significant and unexpected.

DETAILED DESCRIPTION OF THE INVENTION

Figure 1:
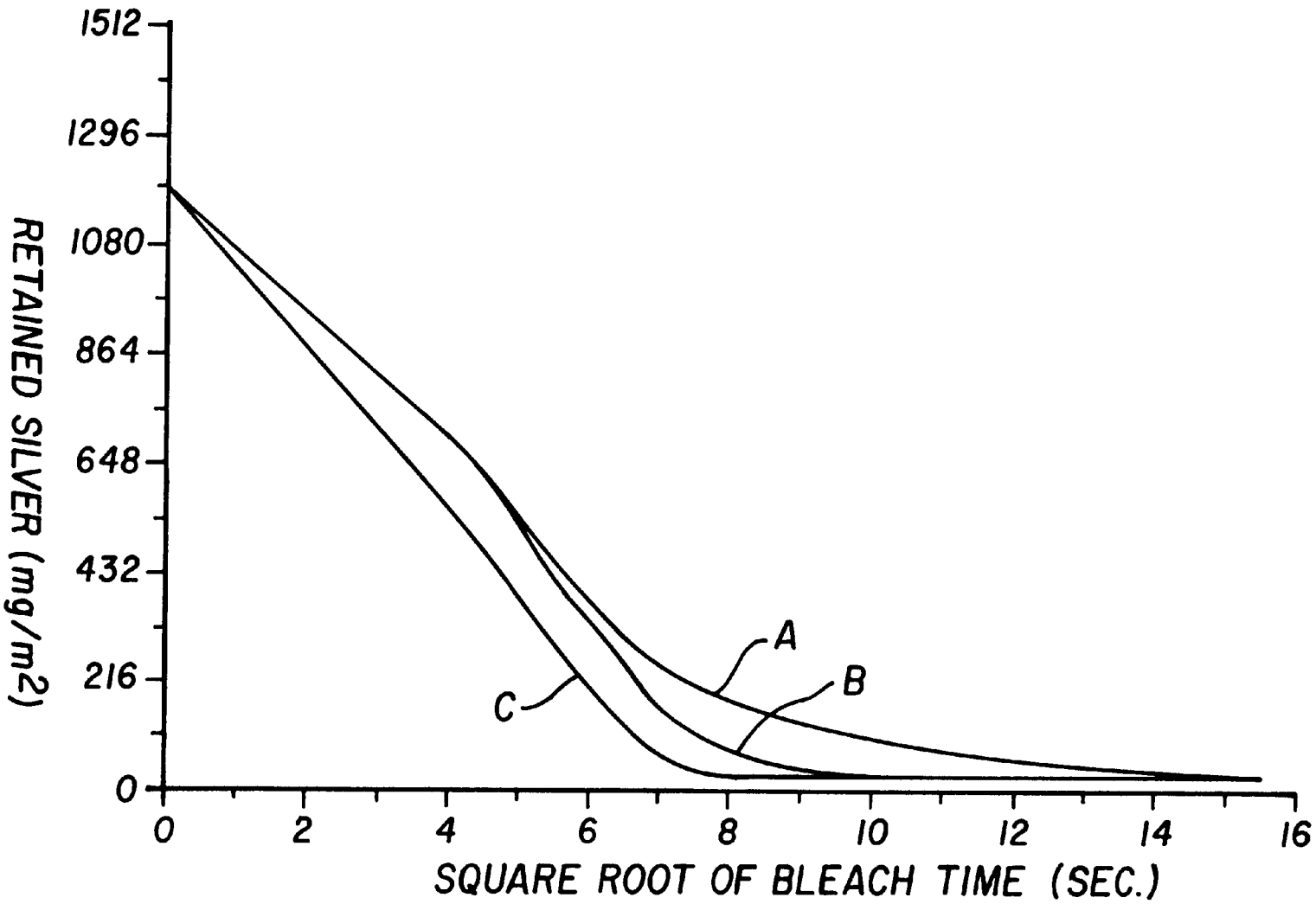
FIG. 1 is a graphical representation of data obtained in Examples 1–2 below, showing the effect on bleaching rate with levels of PDCA in the bleaching compositions.

The essential aromatic carboxylic acids used in this invention comprise at least one carboxyl group and an aromatic nitrogen heterocycle. They are water-soluble and preferably biodegradable, and are present in the compositions of this invention in substantially uncomplexed form. In other words, they are in admixture with the bleaching agent, and are not a part of the ferric complex bleaching agent to any appreciable extent. If any aromatic carboxylic acid is complexed with ferric ion in the composition, the amount is insignificant for bleaching, and would generally be less than 0.02:1 (molar ratio of complexed aromatic carboxylic acid to ferric ion).

More specifically, these compounds include substituted or unsubstituted 2-pyridinecarboxylic acids and substituted or unsubstituted 2,6-pyridinedicarboxylic acids (or equivalent salts). The substituents which may be on the pyridinyl ring include substituted or unsubstituted alkyl, substituted or unsubstituted cycloalkyl or substituted or unsubstituted aryl groups (as defined below for structures III–IX), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring with the pyridinyl nucleus.

The preferred compounds of this type are represented by the following structures:

(I)

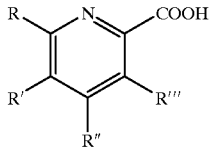

and (II)

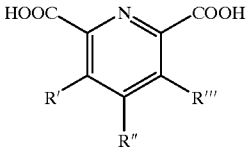

wherein R, R', R" and R"' are independently hydrogen, a substituted or unsubstituted alkyl of 1 to 5 carbon atoms (as defined above), substituted or unsubstituted aryl group of 6 to 10 carbon atoms (as defined above), a substituted or unsubstituted cycloalkyl of 5 to 10 carbon atoms (as defined above), hydroxy, nitro, sulfo, amino, carboxy, sulfamoyl, sulfonamido, phospho or halo (such as chloro or bromo), or any two of R, R', R" and R"' can comprise the carbon atoms necessary to form a substituted or unsubstituted 5 to 7-membered ring fused with the pyridinyl nucleus.

The monovalent and divalent radicals defining Structures I and II can have substituents like those defining the radicals for structures III–IX below.

Preferably, R, R', R" and R"' are independently hydrogen, hydroxy or carboxy. The most preferred compounds are unsubstituted 2-pyridinecarboxylic acid and 2,6-pyridinedicarboxylic acid.

It should be understood that salts of these compounds are equally useful. Useful aromatic carboxylic acids and their salts are also described in various publications, including Japanese Kokai 51-07930 (noted above), EP-A-0 329 088 (noted above) and *J. Chem. Soc. Dalton Trans.,* 619 (1986).

These compounds can be obtained from a number of commercial sources or prepared using conventional procedures and starting materials (see for example, Syper et al, *Tetrahedron,* 36, 123–129, 1980 and Bradshaw et al, *J. Am. Chem. Soc.,* 102(2), 467–74, 1980).

The composition of this invention also includes one or more ternary iron complexes as essential bleaching agents, each complex being composed of iron and one or more ligands as defined herein. Thus, the complexes can be binary (one type of ligand molecule per complex molecule), or ternary (two different ligand molecules per complex molecule) as long as none of the complexed ligands is a compound represented by structures I or II above. Both types of iron complexes are well known, as shown by the art cited above.

The iron salts used to form bleaching agents in the practice of this invention are generally ferric ion salts that provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate is preferred. These salts can be provided in any suitable form and are available from a number of commercial sources.

Alternatively, ferric salts can be generated from the corresponding ferrous ion salts, such as ferrous sulfate, ferrous oxide, ferrous ammonium sulfate and ferrous chloride. Generating the desired ferric ions requires an additional step of oxidation of the ferrous ion by a suitable means, such as by bubbling air or oxygen through a ferrous ion solution.

The ligands used to provide bleaching agents are polycarboxylate or aminocarboxylate ligands which are well known in the art and include compounds having at least two carboxyl groups (polydentate), or their corresponding salts. Such ligands can be bidentate, tridentate, tetradentate, pentadentate and hexadentate ligands, referring to the number of sites available to bind to ferric ion. These ligands must be water-soluble also, and are preferably biodegradable (defined below).

More specifically, such ligands include, but are not limited to, hydroxycarboxylic acids, alkylenediaminetetracarboxylic acids having a tertiary nitrogen atom, polyaminodi- or mono-succinic acids, alkylenediaminepolycarboxylic acids having a secondary nitrogen atom, iminopolyacetic acids, substituted or unsubstituted alkyliminopolycarboxylic acids, aminopolycarboxylic acids having an aliphatic dibasic acid group, and amino ligands having an aromatic or heterocyclic substituent.

Representative useful classes of such ligands are defined below in reference to structures (III)–(IX), although it should be recognized that the invention is not limited in practice to these ligands.

Thus, useful ligands can be compounds having any of the following structures:

(III)

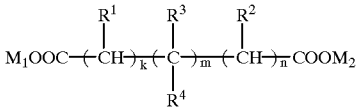

wherein $R^1$ and $R^2$ are independently hydrogen or hydroxy, $R^3$ and $R^4$ are independently hydrogen, hydroxy or carboxy (or a corresponding salt), $M_1$ and $M_2$ are independently hydrogen or a monovalent cation (such as ammonium, sodium, potassium or lithium), k, m and n are 0 or 1, provided that at least one of k, m and n is 1, and further provided that compound (III) has at least one hydroxy group, (IV)

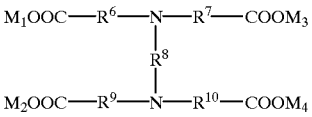

wherein $R^6$, $R^7$, $R^8$, $R^9$ and $R^{10}$ are independently a linear or branched substituted or unsubstituted alkylene group of 1 to 8 carbon atoms (such as methylene, ethylene, trimethylene, hexamethylene, 2-methyltrimethylene and 4-ethylhexamethylene), and $M_1$, $M_2$, $M_3$ and $M_4$ are independently hydrogen or a monovalent cation, as defined above for $M_1$ and $M_2$, (V)

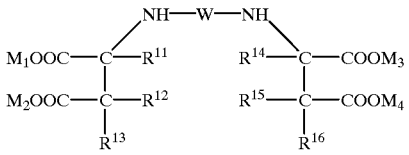

wherein $R^{11}$, $R^{12}$, $R^{13}$, $R^{14}$, $R^{15}$ and $R^{16}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), $M_1$, $M_2$, $M_3$ and $M_4$ are as defined above, and W is a covalent bond or a divalent substituted or unsubstituted aliphatic linking group (defined below), (VI)

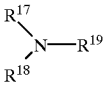

wherein at least two of $R^{17}$, $R^{18}$ and $R^{19}$ are a carboxymethyl (or equivalent salts), and the third group is hydrogen, a substituted or unsubstituted alkyl group of 1 to 5 carbon atoms (as defined above), a substituted or unsubstituted hydroxyethyl or unsubstituted carboxymethyl (or equivalent salts), (VII)

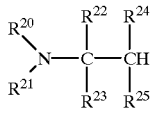

wherein $R^{20}$ and $R^{21}$ are independently substituted or unsubstituted carboxymethyl (or equivalent salts) or 2-carboxyethyl (or equivalent salts), and $R^{22}$, $R^{23}$, $R^{24}$ and $R^{25}$ are independently hydrogen, a substituted or unsubstituted alkyl group of 1 to 5 carbon atoms (as defined above), hydroxy, carboxy or substituted or unsubstituted carboxymethyl (or equivalent salts), provided that only one of $R^{22}$, $R^{23}$, $R^{24}$ and $R^{25}$ is carboxy or substituted or unsubstituted carboxymethyl (or equivalent salts), (VIII)

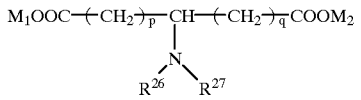

wherein $R^{26}$ and $R^{27}$ are independently hydrogen, a substituted or unsubstituted alkyl of 1 to 5 carbon atoms (as defined above), substituted or unsubstituted hydroxyethyl, substituted or unsubstituted carboxymethyl or 2-carboxyethyl (or equivalent salts), $M_1$ and $M_2$ are as defined above, and p and q are independently 0, 1 or 2 provided that the sum of p and q does not exceed 2, or (IX)

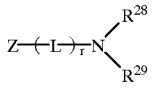

wherein

Z represents a substituted or unsubstituted aryl group of 6 to 10 carbon atoms in the nucleus (as defined above) or a substituted or unsubstituted heterocycle having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, pyridinyl, piperidinyl, pyrazinyl, triazinyl, oxazinyl, azepinyl, oxepinyl and thiapinyl), L is a divalent substituted or unsubstituted aliphatic linking group (defined below), $R^{28}$ and $R^{29}$ are independently hydrogen, a substituted or unsubstituted alkyl group of 1 to 5 carbon atoms (as defined above), substituted or unsubstituted carboxyalkyl of 2 to 4 carbon atoms (such as substituted or unsubstituted carboxymethyl or carboxyethyl or equivalent salts) or hydroxy-substituted carboxyalkyl of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups which form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others which would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, sulfo, carbonamido, sulfonamido, sulfamoyl, sulfonato, thioalkyl, alkylcarbonamido, alkylcarbamoyl, alkylsulfonamido, alkylsulfamoyl carboxyl, amino, halo (such as chloro or bromo), sulfono (—$SO_2$R) or sulfoxo [—S(O)R] wherein R is a branched or linear alkyl group of 1 to 5 carbon atoms.

In reference to the foregoing structures (III)–(IX), preferred definitions of groups are as follows:

$R^1$ and $R^2$ are independently hydrogen or hydroxy, $R^3$ and $R^4$ are independently hydroxy or carboxy, provided at least one hydroxy group is in compound (I), $R^6$, $R^7$, $R^8$, $R^9$ and $R^{10}$ are independently alkylene of 1 to 3 carbon atoms, $M_1$, $M_2$, $M_3$ and $M_4$ are independently hydrogen, ammonium, sodium or potassium, $R^{11}$, $R^{12}$, $R^{13}$, $R^{14}$, $R^{15}$ and $R^{16}$ are independently hydrogen, hydroxy or methyl, W is a covalent bond or substituted or unsubstituted alkylene of 1 to 3 carbon atoms, at least two of $R^{17}$, $R^{18}$ and $R^{19}$ are carboxymethyl and the third group is hydrogen, methyl, carboxymethyl or carboxyethyl, $R^{20}$ and $R^{21}$ are each carboxymethyl, $R^{22}$, $R^{23}$, $R^{24}$ and $R^{25}$ are independently hydrogen, carboxymethyl or carboxy, $R^{26}$ and $R^{27}$ are independently hydrogen, methyl or carboxymethyl, Z represents 2-pyridyl or 2-imidazolyl, L is substituted or unsubstituted alkylene of 1 to 3 carbon atoms, $R^{28}$ and $R^{29}$ are independently hydrogen, 2-carboxyethyl or carboxymethyl, and r is 1.

More preferred ligands are iminodiacetic acid, methyliminodiacetic acid, nitrilotriacetic acid, β-alaninediacetic acid, alaninediacetic acid, ethylenediamine disuccinic acid, propylenediaminetetraacetic acid (PDTA), ethylenediamine monosuccinic acid, ethylenediaminetetraacetic acid (EDTA), alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid, 2-pyridylmethyliminodiacetic acid, and mixtures thereof. Certain biodegradable ligands (such as nitrilotriacetic acid, β-alaninediacetic acid, methyliminodiacetic acid, iminodiacetic acid, and ethylenediaminedisuccinic acid) in this list are more preferred. Of those, methyliminodiacetic acid is most preferred as a biodegradable ligand. PDTA and EDTA are most preferred non-biodegradable ligands.

Besides those ligands specifically defined in the foregoing description, there is considerable literature which describes additional useful ligands, such as EP-A-0 532,003 (Ueda et al), EPA 0 567 126 (Seki et al), EP-A-0 654,705 (Suzuki et al), U.S. Pat. No. 5,250,401 (Okada et al) U.S. Pat. No. 5,250,402 (Okada et al), U.S. Pat. No. 5,338,649 (Inaba et al) and U.S. Pat. No. 5,391,466 (Ueda et al).

Many of these materials are commercially available or can be prepared by methods known to those skilled in the art.

As used herein, the terms "biodegradable" or "biodegradability" refer to at least 80% decomposition in the standard test protocol specified by the Organization for Economic Cooperation and Development (OECD), Test Guideline 302B (Paris, 1981), also known as the "Modified Zahn-Wellens Test".

The concentration of ferric ion in the bleaching agent is generally at least 0.0005 mol/l. The specific amount for optimum effect will vary depending upon the specific ligands used and the specific use of the complex. For example, the concentration of the complex when used as a bleaching agent in a rehalogenating bath may be different than when the complex is in a bleach-fixing bath. The amount of iron salt needed to obtain the desired amount of ferric ion in the complex would be readily apparent to one skilled in the art.

In the most general sense, the concentration of ferric ion is from about 0.005 to about 1 mol/l, with from about 0.005 to about 0.5 mol/l being preferred. The amount of ferric ion is preferably from about 0.01 to about 0.5 mol/l, with more preferred amounts being from about 0.02 to about 0.2 mol/l. In bleach-fixing compositions, the preferred amount of ferric ion is from about 0.01 to about 0.3 mol/l, with more preferred amounts being from about 0.02 to about 0.15 mol/l.

The molar ratio of complexing ligand to ferric ion in the bleaching agent is at least about 1:1, but the amounts can vary depending upon the specific ligand used and the use of the complex. More generally, the molar ratio is from about 1:1 to about 5:1, but preferred ratios are from about 1:1 to about 3.5:1. At molar ratios less than about 1:1, rust formation and staining are more likely, and there is a greater tendency for the formation of water-insoluble salts.

The molar ratio of the aromatic uncomplexed carboxylic acid to ferric ion is at least about 0.02:1. As with the other components of the complex, the optimum amount will vary depending upon the specific compound and bleaching agent used. A more general molar ratio is from about 0.02:1 to about 0.8:1. A preferred ratio is from about 0.1:1 to about 0.7:1. Thus, within these ranges, the optimum ratio will be different for each combination of uncomplexed aromatic carboxylic acid and ferric complex bleaching agent used. With the teaching within the examples below, one skilled in the art would readily know how to determine the optimum ratio with routine experimentation.

The pH value of the composition of the present invention is preferably in the range of from about 2 to about 8, and most preferably in the range of from about 3 to about 7.

In order to adjust and control the pH, the composition includes one or more organic acidic compounds other than the ferric ion complexed aminopolycarboxylic acid or aromatic carboxylic acid described above. Such compounds are typically weak acids having a $pK_a$ between about 1.5 and about 7. Preferably, such acids are carboxylic acids having one or more carboxyl groups and a $pK_a$ of from about 2.5 to about 7. The amount of acid used is generally at least about 0.05 mol/l, and more preferably from about 0.1 to about 3 mol/l.

Useful acidic compounds include, but are not limited to, monobasic acids (such as acetic acid, propionic acid, glycolic acid, benzoic acid and sulfobenzoic acid), amino acids (such as asparagine, aspartic acid, glutamic acid, alanine, arginine, glycine, serine and leucine), dibasic acids (such as oxalic acid, malonic acid, succinic acid, glutaric acid, tartaric acid, fumaric acid, maleic acid, malic acid, oxaloacetic acid, phthalic acid, 4-sulfophthalic acid, 5-sulfoisophthalic acid and sulfosuccinic acid), tribasic acids (such as citric acid), and ammonium or alkali metal salts of any of the foregoing acids. Examples of preferred acids are acetic acid, glycolic acid, maleic acid, succinic acid, sulfosuccinic acid, 5-sulfoisophthalic acid and 4-sulfophthalic acid. Preferred acids are acetic acid and succinic acid.

In one embodiment, the composition of this invention is used for bleach-fixing, and it contains one or more fixing agents, such as thiosulfates, thiocyanates, thioethers, amines, mercapto-containing compounds, thiones, thioureas, iodides and others which would be readily apparent to one skilled in the art. Particularly useful fixing agents include, but are not limited to, ammonium thiosulfate, sodium thiosulfate, potassium thiosulfate and guanidine thiosulfate, with ammonium thiosulfate being particularly preferred for rapid fixing. Useful and optimum amounts of fixing agents would be readily apparent to one skilled in the art, and are generally from about 0.1 to about 3.0 mol/l.

The bleach-fixing composition may also contain a preservative such as a sulfite, for example, ammonium sulfite, a bisulfite, or a metabisulfite salt, or one or more bleaching or fixing accelerators.

Further details of bleaching and bleach-fixing compositions (other components, pH and other features) are well known and described, for example, in *Research Disclosure,* publication 365, September, 1994. *Research Disclosure* is a publication of Kenneth Mason Publications Ltd., Dudley House, 12 North Street, Emsworth, Hampshire P010 7DQ England (also available from Emsworth Design Inc., 121 West 19th Street, New York, N.Y. 10011). This reference will be referred to hereinafter as "*Research Disclosure*".

In a preferred embodiment of this invention, the bleaching composition of this invention comprises one or more rehalogenating agents, such as a halide (for example, chloride, bromide or iodide). Bromide ion is preferably used as the rehalogenating agent. Generally, the amount of rehalogenating agent is from about 0.05 to about 2 mol/l with from about 0.1 to about 1 mol/l being preferred. The counterion used for the rehalogenating agent can be any acceptable cation such as ammonium, alkali metal or alkaline earth ions. Ammonium is preferred for bleaching efficiency and water solubility, but sodium and potassium may be more environmentally desirable.

The composition of this invention can also be what is known in the art as a silver-retentive bleaching composition and contain an organic silver salt instead of a halide rehalogenating agent, as described for example, in U.S. Pat. No. 4,454,224 (Brien et al).

The composition of this invention can optionally contain one or more addenda commonly included in bleaching or bleach-fixing compositions, such as bleach accelerators, corrosion inhibitors, optical whitening agents, defoaming agents, calcium sequestrants and chlorine scavengers. The compositions can be formulated as a working bleach or bleach-fixing solutions, replenishers, concentrates or as dry powders or tablets.

The photographic elements to be processed using the present invention can contain any of the conventional silver halides as the photosensitive material, for example, silver chloride, silver bromide, silver bromoiodide, silver chlorobromide, silver chloroiodide, and mixtures thereof. In one embodiment, the photographic element is a high silver chloride element (that is predominantly silver chloride), containing at least 50 mole % silver chloride and more preferably at least 90 mole % silver chloride, for example as are often used in photographic color papers.

In another embodiment, at least one emulsion is predominantly silver bromide (at least 50 mol % silver bromide). Most preferably, the elements contain one or more color records, each color record having one or more predominantly silver bromide emulsions such as are used in photographic color negative and color reversal films.

The photographic elements processed in the practice of this invention can be single color elements or multicolor elements. Multicolor elements typically contain dye image-forming units sensitive to each of the three primary regions of the visible spectrum (often known as three color records, that is red, green and blue color records). Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. The element can contain additional layers such as filter layers, interlayers, overcoat layers, subbing layers and the like as is well known in the art. The element may also contain a magnetic backing such as is also known in the art.

Considerably more details of photographic elements of many varieties are provided in the "*Research Disclosure*" publication noted above, which is incorporated herein by reference. Such details relate, for example, to useful silver halide emulsions (either negative-working or positive-working) and their preparation, color-forming couplers, color developing agents and solutions, brighteners, antifoggants, image dye stabilizers, hardeners, plasticizers, lubricants, matting agents, paper and film supports, and the various image-formation processes for both negative-image and positive-image forming color elements. Other suitable emulsions are (111) tabular silver chloride emulsions such as described in U.S. Pat. No. 5,176,991 (Jones et al), U.S. Pat. No. 5,176,992 (Maskasky et al), U.S. Pat. No. 5,178,997 (Maskasky), U.S. Pat. No. 5,178,998 (Maskasky et al), U.S. Pat. No. 5,183,732 (Maskasky), U.S. Pat. No. 5,185,239 (Maskasky), U.S. Pat. No. 5,292,632 (Maskasky), U.S. Pat. No. 5,314,798 (Brust) and U.S. Pat. No. 5,320,938 (House et al).

It is particularly useful to process photographic elements containing at least one cyan dye forming coupler that provides a cyan dye, and more especially a 1-naphthol type cyan dye. Such cyan dye forming couplers are typically in the red record of multicolor photographic elements including color negative films and color papers. Representative useful cyan dye forming couplers of the 1-naphthol type are well known in the art and described, for example, in many of the cyan coupler references cited in *Research Disclosure,* noted above.

Photographic elements can be exposed to actinic radiation, typically in the visible region of the spectrum, to form a latent image using known methods and then processed to form a visible dye image. Processing of color photographic elements includes the step of contacting the element with a color developing agent to reduce developable silver halide and to oxidize the color developing agent. Oxidized color developing agent in turn reacts with the coupler to yield a dye in the various color records.

Photographic color developing compositions are employed in the form of aqueous alkaline working solutions having a pH of above 7 and most typically in the range of from about 9 to about 13, and are well known in the art.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the steps of bleaching and fixing, or bleach-fixing to remove silver and silver halide, washing and drying.

In some cases, a separate pH lowering solution, referred to as a stop bath, is employed to terminate development prior to bleaching. A stabilizer bath is commonly employed for final washing and hardening of the bleached and fixed photographic element prior to drying.

Preferred processing sequences for color photographic elements, particularly color negative films and color print papers, include, but are not limited to, the following:

(P-1) Color development/Stop/Bleach-fixing/Washing/Stabilizing/Drying.

(P-2) Color development/Stop/Bleach-fixing/Stabilizing/Drying.

(P-3) Color development/Bleach-fixing/Washing/Stabilizing/Drying.

(P-4) Color development/Bleach-fixing/Washing.

(P-5) Color development/Bleach-fixing/Stabilizing/Drying.

(P-6) Color development/Stop/Washing/Bleach-fixing/Washing/Drying.

(P-7) Color development/Bleaching/Fixing/Stabilizing.

(P-8) Color development/Bleaching/Washing/Fixing/Washing/Stabilizing.

(P-9) Color development/Bleaching/Bleach-fixing/Fixing/Stabilizing.

In each of processes (P-1) to (P-9), variations are contemplated. For example, a bath can be employed prior to color development, such as a prehardening bath, or the washing step may follow the stabilizing step. Additionally, reversal processes which have the additional steps of black and white development, chemical fogging bath, light re-exposure, and washing before the color development are contemplated.

Processing according to the present invention can be carried out using conventional deep tanks holding processing solutions. Alternatively, it can be carried out using what is known in the art as "low volume thin tank" processing systems using either rack and tank or automatic tray designs. Such processing methods and equipment are described, for example, in U.S. Pat. No. 5,436,118 (Carli et al) and publications cited therein.

The following examples are intended to illustrate, but not limit, this invention.

Materials and Methods for Examples

The processing methods used in the examples utilized conventional Process C-41 processing steps and conditions, except for the bleaching solutions that were modified according to the present invention.

EXAMPLES 1 & 2

Processing of Color Negative Film with Accelerated Bleaching

Samples of commercially available KODAK KODACOLOR GOLD ULTRA 400 speed color negative film were imagewise exposed and processed. They were bleached using bleaching compositions having the following basic formulation mixture but with various amounts of the bleaching accelerator, 2,3-pyridinedicarboxylic acid ("PDCA"):

| | |
|---|---|
| Ferric-MIDA Complex | 41.5 g/l |
| 2,6-Pyridinedicarboxylic acid | See below |
| Glacial acetic acid buffer | 52.5 g/l |
| Potassium bromide | 30 g/l |
| Total Fe | 0.12 mol/l |
| pH | 4.0 |

TABLE I below lists the levels of PDCA bleaching accelerator and the resulting bleaching effectiveness (retained silver metal at Dmax in mg/m$^2$) of the bleaching compositions of the invention as well as a conventional bleaching composition (Control A) containing no PDCA bleaching accelerator.

TABLE I

| Bleaching Time (sec) | Control A 0 mol/l PDCA | Example 1 0.04 mol/l PDCA 0.33:1 PDCA:Fe molar ratio | Example 2 0.08 mol/l PDCA 0.67:1 PDCA:Fe molar ratio |
|---|---|---|---|
| 0 | 1195 | 1195 | 1195 |
| 20 | 631.6 | 643.9 | 478.1 |
| 30 | 455.7 | 414.3 | 295.2 |
| 40 | 328.8 | 288.9 | 153.7 |
| 50 | 239.1 | 152.1 | 56.12 |
| 60 | 197.7 | 90.93 | 24.01 |
| 75 | 147.5 | 40.88 | 22.94 |
| 90 | 107.1 | 29.7 | 23.63 |
| 120 | 72.99 | 28.43 | 23.85 |
| 150 | 52.50 | 27.40 | 22.83 |
| 180 | 42.70 | 27.32 | 23.44 |
| 240 | 30.26 | 28.88 | 25.96 |

The data in TABLE I are also presented graphically in FIG. 1 (retained silver vs. square root of bleaching time) wherein Curve A represents the data from the Control A method, and Curves B and C represent the data from Examples 1 and 2, respectively. It is apparent that as the level of bleaching accelerator increased, the rate of silver bleaching was substantially increased as measured by the decreased amount of retained silver metal.

EXAMPLES 3–6

Bleaching of Color Photographic Films with Colorless Cyan Dye Recovery

Samples of commercially available KODAK VERICOLOR II Type L color negative film were imagewise exposed and processed. This type of color negative film contains a cyan dye forming color coupler of the 1-naphthol type. They were bleached using bleaching compositions having the basic formulation mixture described in Examples 1–2 but with various amounts of the bleaching accelerator, 2,3-pyridinedicarboxylic acid as shown below in TABLE II.

Figure 2:
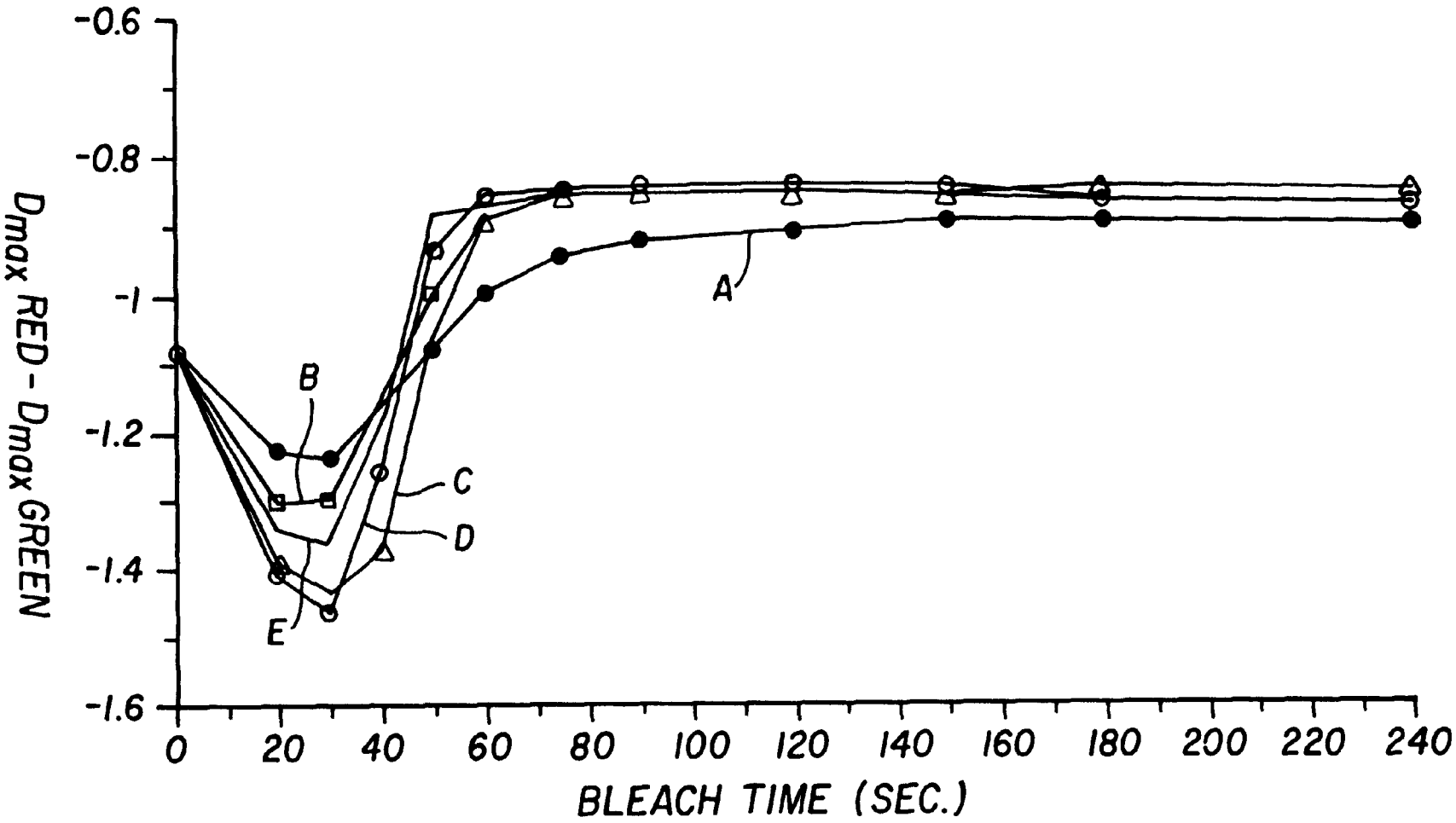
FIG. 2 is a graphical representation of data obtained in Examples 3–6 below, showing the effect on colorless cyan dye recovery with level of PDCA in the bleaching compositions.

The effect of these bleaching compositions on color cyan dye recovery was measured. The results are shown below in TABLE II, and in FIG. 2 wherein Curve A represents the data from Control B, and Curves B, C, D and E represent the data from Examples 3, 4, 5 and 6, respectively. Colorless cyan dye recovery is measured as the red color record Dmax ("Dmax Red") minus the green color record Dmax ("Dmax Green") which is unchanging, identified herein as the "recovery parameter": (Dmax Red)−(Dmax Green). It is apparent from the data that as the level of PDCA is increased, the time required for (Dmax Red)−(Dmax Green) to become less than −1 was significantly decreased proportionately. Once all of the colorless cyan dye has been converted to cyan dye, the recovery parameter remains constant.

TABLE II

| Bleach time (sec) | Control B 0 PDCA | Example 3 0.02 mol/l PDCA:Fe of 0.167:1 | Example 4 0.04 mol/l PDCA:Fe of 0.33:1 | Example 5 0.06 mol/l PDCA:Fe of 0.5:1 | Example 6 0.08 mol/l PDCA:Fe of 0.67:1 |
|---|---|---|---|---|---|
| 0 | −1.08 | −1.08 | −1.08 | −1.08 | −1.08 |
| 20 | −1.23 | −1.303 | −1.39 | −1.408 | −1.342 |
| 30 | −1.245 | −1.3 | −1.434 | −1.464 | −1.363 |
| 40 | −1.158 | −1.165 | −1.368 | −1.259 | −1.195 |
| 50 | −1.08 | −0.999 | −1.066 | −0.932 | −0.884 |

TABLE II-continued

| Bleach time (sec) | Control B 0 PDCA | Example 3 0.02 mol/l PDCA:Fe of 0.167:1 | Example 4 0.04 mol/l PDCA:Fe of 0.33:1 | Example 5 0.06 mol/l PDCA:Fe of 0.5:1 | Example 6 0.08 mol/l PDCA:Fe of 0.67:1 |
|---|---|---|---|---|---|
| 60 | −0.995 | −0.887 | −0.893 | −0.854 | −0.871 |
| 75 | −0.942 | −0.854 | −0.845 | −0.85 | −0.86 |
| 90 | −0.92 | −0.85 | −0.853 | −0.845 | −0.858 |
| 120 | −0.904 | −0.851 | −0.854 | −0.844 | −0.853 |
| 150 | −0.891 | −0.853 | −0.853 | −0.842 | −0.858 |
| 180 | −0.892 | −0.861 | −0.839 | −0.862 | −0.86 |
| 240 | −0.893 | −0.86 | −0.843 | −0.865 | −0.867 |

EXAMPLES 7 & 8

Accelerated Bleaching Using Ferric-NTA Bleaching Agent

Samples of commercially available KODAK ROYAL GOLD 1000 speed color negative film were imagewise exposed and processed. They were bleached using bleaching compositions having the following basic formulation mixture but with various amounts of the bleaching accelerator, 2,3-pyridinedicarboxylic acid:

| | |
|---|---|
| Ferric-NTA Complex (NTA is nitrilotriacetic acid) | 29.4 g/l |
| 2,6-Pyridinedicarboxylic acid | See below |
| Glacial acetic acid buffer | 52.5 g/l |
| Potassium bromide | 30 g/l |
| Total Fe | 0.12 mol/l |
| pH | 4.0 |

TABLE III below lists the levels of bleaching accelerator and the resulting bleaching effectiveness (retained silver metal at Dmax in mg/m$^2$) of the bleaching compositions of the invention as well as a conventional bleaching composition (Control C) containing no bleaching accelerator.

TABLE III

| Bleaching Time (sec) | Control C 0.001 mol/l 0.008:1 PDCA:Fe molar ratio | Example 7 0.01 mol/l PDCA 0.08:1 PDCA:Fe molar ratio | Example 8 0.06 mol/l PDCA 0.5:1 PDCA:Fe molar ratio |
|---|---|---|---|
| 0 | 1498 | 1498 | 1498 |
| 20 | 1098 | 1075 | 954.1 |
| 30 | 965.5 | 952.8 | 755.2 |
| 45 | 817.1 | 796.6 | 582.7 |
| 60 | 715.2 | 698.4 | 477.3 |
| 90 | 554.0 | 516.8 | 340.3 |
| 120 | 424.3 | 390.2 | 127.3 |
| 150 | 292.4 | 252.9 | 49.49 |
| 180 | 209.5 | 171.4 | 21.45 |
| 240 | 125.0 | 84.08 | 18.33 |

Figure 3:
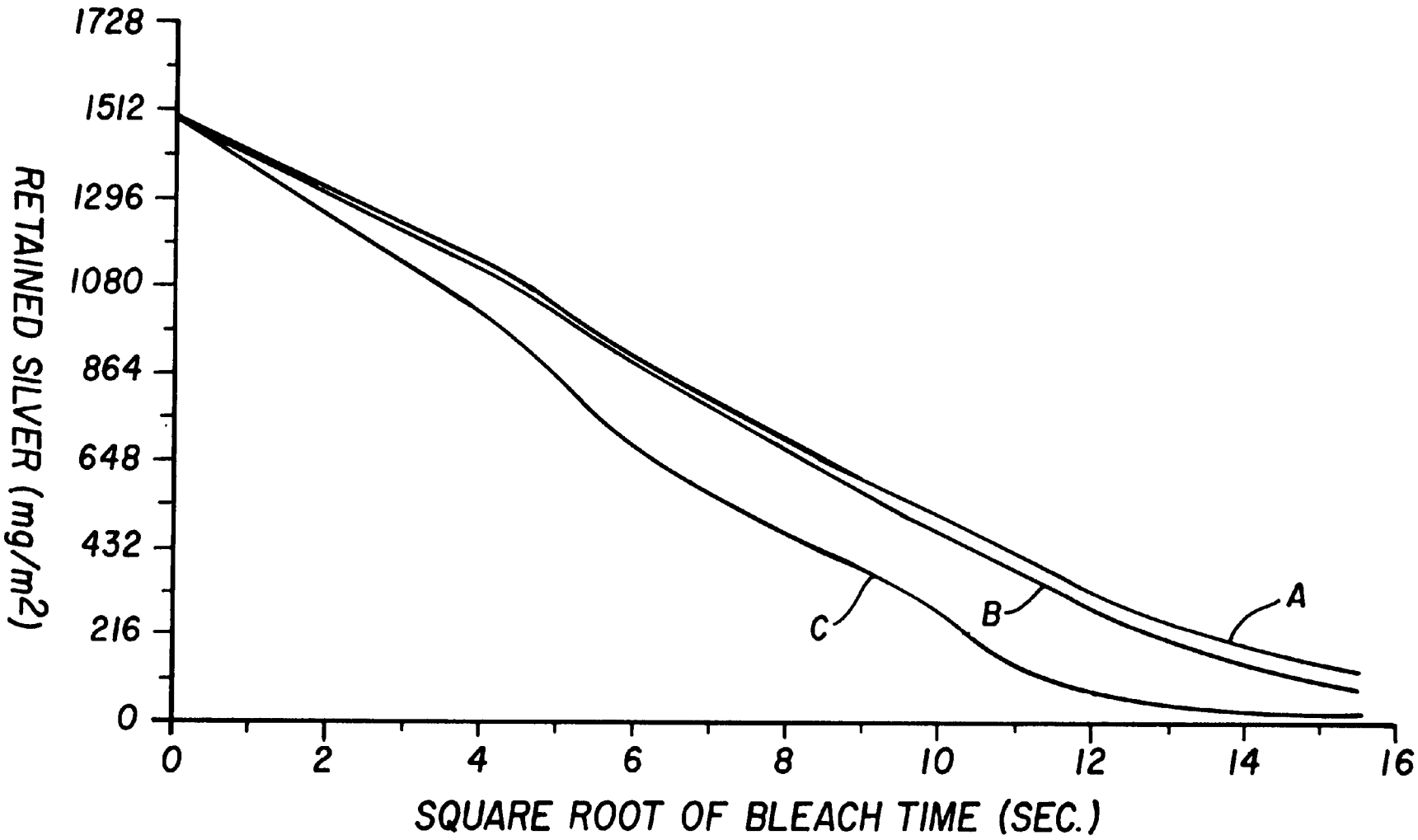
FIG. 3 is a graphical representation of data obtained in Examples 7–8 below, showing the effect on bleaching rate with levels of PDCA in the bleaching compositions.

The data in TABLE III are also presented graphically in FIG. 3 (retained silver vs. square root of bleaching time) wherein Curve A represents the data from the Control C method, and Curves B and C represent the data from Examples 7 and 8, respectively. It is apparent that as the level of bleaching accelerator increased, the rate of silver bleaching was substantially increased as measured by the decreased amount of retained silver metal. In Example 8, complete bleaching was achieved within 3 minutes. Control C contained insufficient bleach accelerator for the purposes of this invention.

EXAMPLES 9–11

Bleaching of Color Photographic Films with Colorless Cyan Dye Recovery

Samples of commercially available KODAK VERICOLOR II Type L color negative film were imagewise exposed and processed. They were bleached using bleaching compositions having the basic formulation mixture described in Examples 7–8 but with various amounts of the bleaching accelerator, 2,3-pyridinedicarboxylic acid as shown below in TABLE IV.

Figure 4:
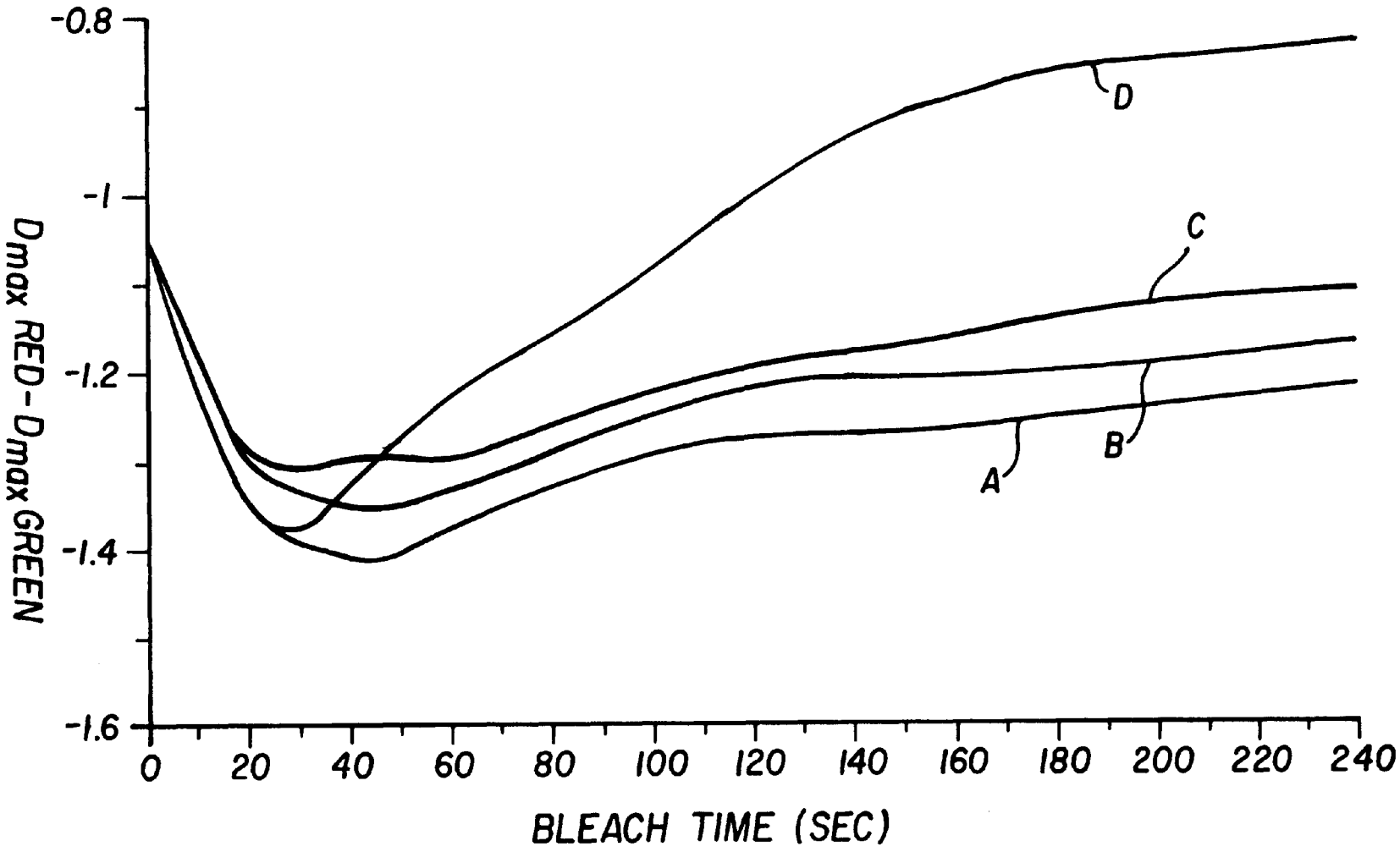
FIG. 4 is a graphical representation of data obtained in Examples 9–11 below, showing the effect on colorless cyan dye recovery with level of PDCA in the bleaching compositions.

The effect of these bleaching compositions on color cyan dye recovery was measured. The results are shown below in TABLE IV, and in FIG. 4 wherein Curve A represents the data from Control D, and Curves B, C and D represent the data from Examples 9, 10 and 11, respectively. Colorless cyan dye recovery is measured as described above. It is apparent from the data that as the level of PDCA is increased, the time required for (Dmax Red)–(Dmax Green) to become less than −1 was decreased proportionately.

TABLE IV

| Bleach time (sec) | Control D 0.001 mol/l PDCA:Fe of 0.008:1 | Example 3 0.006 mol/l PDCA:Fe of 0.05:1 | Example 4 0.01 mol/l PDCA:Fe of 0.08:1 | Example 6 0.06 mol/l PDCA:Fe of 0.5:1 |
|---|---|---|---|---|
| 0 | −1.046 | −1.046 | −1.046 | −1.046 |
| 20 | −1.347 | −1.306 | −1.295 | −1.361 |
| 30 | −1.391 | −1.336 | −1.309 | −1.383 |
| 45 | −1.417 | −1.356 | −1.29 | −1.295 |
| 60 | −1.374 | −1.335 | −1.3 | −1.224 |
| 90 | −1.309 | −1.267 | −1.242 | −1.125 |
| 120 | −1.274 | −1.215 | −1.189 | −0.999 |
| 150 | −1.269 | −1.205 | −1.169 | −0.908 |
| 180 | −1.249 | −1.201 | −1.137 | −0.859 |
| 240 | −1.215 | −1.167 | −1.105 | −0.825 |

EXAMPLES 12–14

Accelerated Bleaching with Ferric-EDTA Bleaching Agent

Samples of commercially available KODAK ROYAL GOLD 1000 speed color negative film were imagewise exposed and processed. They were bleached using bleaching compositions having the following basic formulation but with various amounts of the bleaching accelerator, 2,3-pyridinedicarboxylic acid:

| | |
|---|---|
| Ferric-EDTA Complex | 43.8 g/l |
| 2,6-Pyridinedicarboxylic acid | See below |
| Glacial acetic acid buffer | 52.5 g/l |
| Potassium bromide | 30 g/l |
| Total Fe | 0.12 mol/l |
| pH | 4.0 |

TABLE V below lists the levels of bleaching accelerator and the resulting bleaching effectiveness (retained silver metal at Dmax in mg/m$^2$) of the bleaching compositions of the invention as well as a conventional bleaching composition (Control E) containing no bleaching accelerator.

TABLE V

| Bleaching Time (sec) | Control E 0.001 mol/l 0.008:1 PDCA:Fe molar ratio | Example 12 0.006 mol/l 0.05:1 PDCA:Fe molar ratio | Example 13 0.01 mol/l PDCA 0.08:1 PDCA:Fe molar ratio | Example 14 0.06 mol/l PDCA 0.5:1 PDCA:Fe molar ratio |
|---|---|---|---|---|
| 0 | 1498 | 1498 | 1498 | 1498 |
| 20 | 1219 | 1217 | 1266 | 1134 |
| 30 | 1114 | 1089 | 1135 | 945.3 |
| 45 | 1019 | 993.3 | 1019 | 766.0 |
| 60 | 945.1 | 911.3 | 915.1 | 659.2 |
| 90 | 805.9 | 764.6 | 760.8 | 463.8 |
| 120 | 696.1 | 664.1 | 646.2 | 313.7 |
| 150 | 608.9 | 564.2 | 561.1 | 194.1 |
| 180 | 540.7 | 485.3 | 480.5 | 92.76 |
| 240 | 396.2 | 353.4 | 335.6 | 20.85 |

Figure 5:
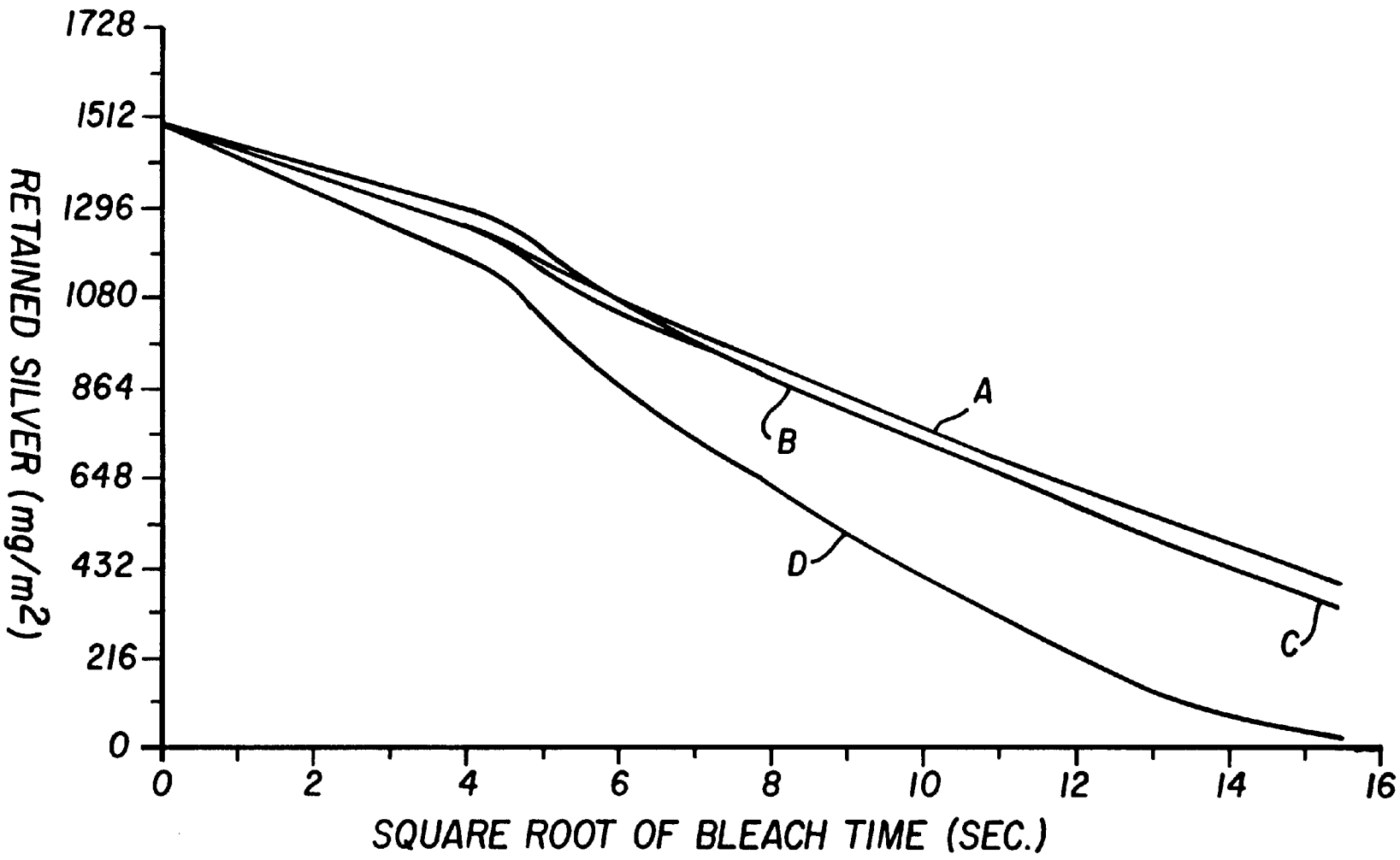
FIG. 5 is a graphical representation of data obtained in Examples 12–14 below, showing the effect on bleaching rate with levels of PDCA in the bleaching compositions.

The data in TABLE V are also presented graphically in FIG. 5 (retained silver vs. square root of bleaching time) wherein Curve A represents the data from the Control E method, and Curves B, C and D represent the data from Examples 12, 13 and 14, respectively. It is apparent that as the level of bleaching accelerator increased, the rate of silver bleaching was substantially increased as measured by the decreased amount of retained silver metal. At the highest level of bleach accelerator, complete bleaching was achieved within 4 minutes. Control E contained insufficient bleach accelerator for the purposes of this invention.

EXAMPLES 15–17

Bleaching of Color Photographic Films with Colorless Cyan Dye Recovery

Samples of commercially available KODAK VERICOLOR II Type L color negative film were imagewise exposed and processed. They were bleached using bleaching compositions having the basic formulation described in Examples 12–14 but with various amounts of the bleaching accelerator, 2,3-pyridinedicarboxylic acid as shown below in TABLE VI.

Figure 6:
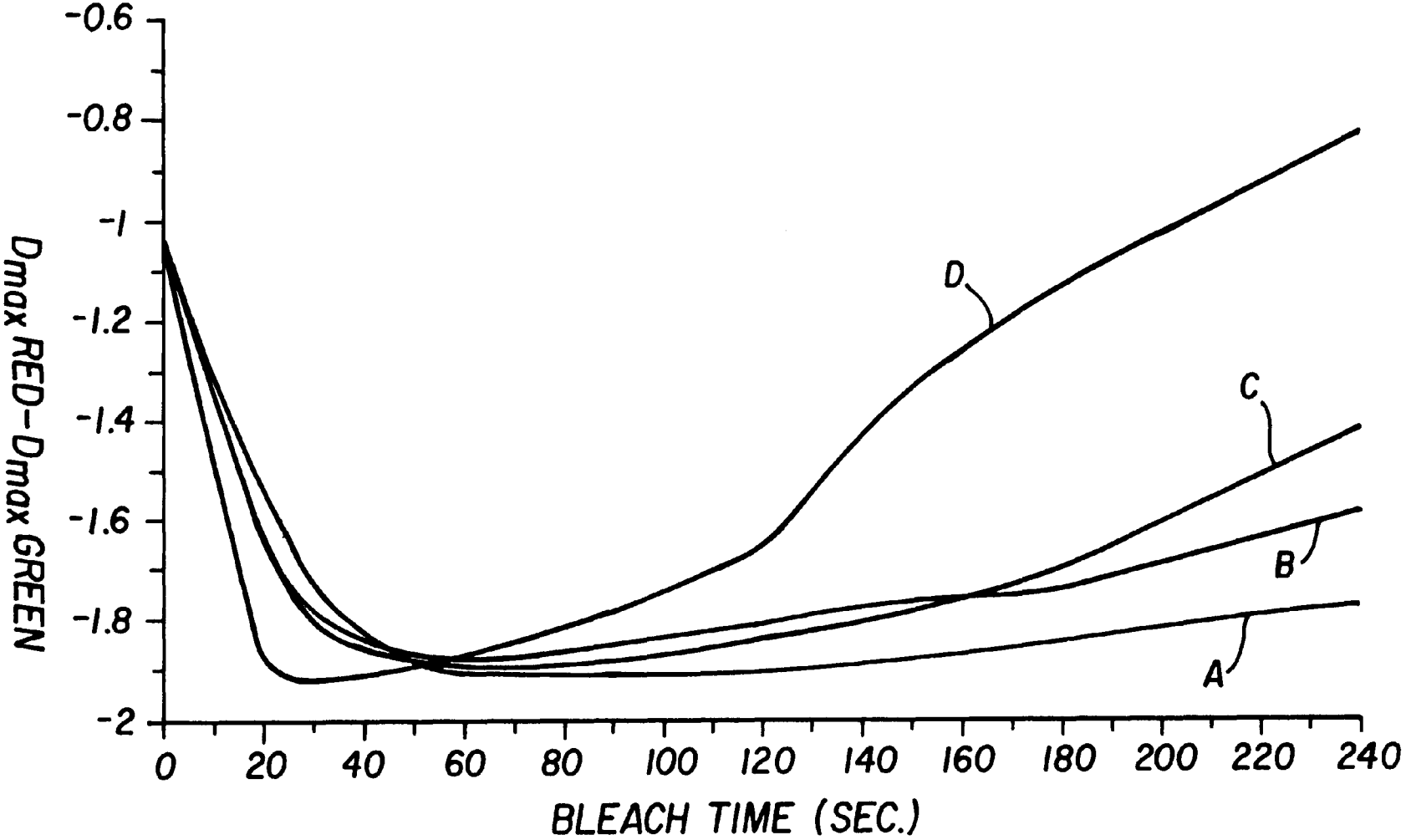
FIG. 6 is a graphical representation of data obtained in Examples 15–17 below, showing the effect on colorless cyan dye recovery with level of PDCA in the bleaching compositions.

The effect of these bleaching compositions on color cyan dye recovery was measured. The results are shown below in TABLE VI, and in FIG. 6 wherein Curve A represents the data from Control F, and Curves B, C and D represent the data from Examples 12, 13 and 14, respectively. Colorless cyan dye recovery is measured as described above. It is apparent from the data that as the level of PDCA is increased, the time required for (Dmax Red)–(Dmax Green) to become less than −1 was decreased proportionately.

TABLE VI

| Bleach time (sec) | Control F 0.001 mol/l PDCA:Fe of 0.008:1 | Example 15 0.006 mol/l PDCA:Fe of 0.05:1 | Example 16 0.01 mol/l PDCA:Fe of 0.08:1 | Example 17 0.06 mol/l PDCA:Fe of 0.5:1 |
|---|---|---|---|---|
| 0 | −1.046 | −1.046 | −1.046 | −1.046 |
| 20 | −1.544 | −1.632 | −1.643 | −1.899 |
| 30 | −1.744 | −1.788 | −1.815 | −1.931 |
| 45 | −1.865 | −1.874 | −1.886 | −1.905 |
| 60 | −1.903 | −1.898 | −1.912 | −1.88 |
| 90 | −1.916 | −1.861 | −1.888 | −1.79 |
| 120 | −1.912 | −1.818 | −1.844 | −1.666 |
| 150 | −1.882 | −1.765 | −1.789 | −1.331 |
| 180 | −1.848 | −1.745 | −1.702 | −1.129 |
| 240 | −1.776 | −1.587 | −1.418 | −0.83 |

EXAMPLES 18–20

Accelerated Bleaching with Ferric-IDA Bleaching Agent

Samples of commercially available KODAK ROYAL GOLD 1000 speed color negative film were imagewise exposed and processed. They were bleached using bleaching compositions having the following basic formulation but with various amounts of the bleaching accelerator, 2,3-pyridinedicarboxylic acid:

| | |
|---|---|
| Ferric-IDA Complex ("IDA" is iminodiacetic acid) | 38.2 g/l |
| 2,6-Pyridinedicarboxylic acid | See below |
| Glacial acetic acid buffer | 52.5 g/l |
| Potassium bromide | 30 g/l |
| Total Fe | 0.12 mol/l |
| pH | 4.0 |

TABLE VII below lists the levels of bleaching accelerator and the resulting bleaching effectiveness (retained silver metal at Dmax in mg/m$^2$) of the bleaching compositions of the invention as well as a conventional bleaching composition (Control G) containing no bleaching accelerator.

TABLE VII

| Bleaching Time (sec) | Control G 0.001 mol/l 0.008:1 PDCA:Fe molar ratio | Example 18 0.006 mol/l 0.05:1 PDCA:Fe molar ratio | Example 19 0.01 mol/l PDCA 0.08:1 PDCA:Fe molar ratio | Example 20 0.06 mol/l PDCA 0.5:1 PDCA:Fe molar ratio |
|---|---|---|---|---|
| 0 | 1498 | 1498 | 1498 | 1498 |
| 20 | 908.2 | 845.6 | 836.5 | 749.0 |
| 30 | 738.6 | 682.5 | 663.4 | 560.3 |
| 45 | 554.7 | 485.1 | 475.7 | 382.2 |
| 60 | 413.3 | 371.9 | 326.8 | 226.2 |
| 90 | 217.2 | 162.8 | 142.3 | 31.54 |
| 120 | 128.9 | 84.28 | 57.99 | 21.29 |
| 150 | 83.13 | 44.20 | 31.78 | 20.17 |
| 180 | 63.82 | 28.30 | 22.43 | 22.20 |
| 240 | 40.28 | 18.60 | 20.33 | 20.89 |

Figure 7:
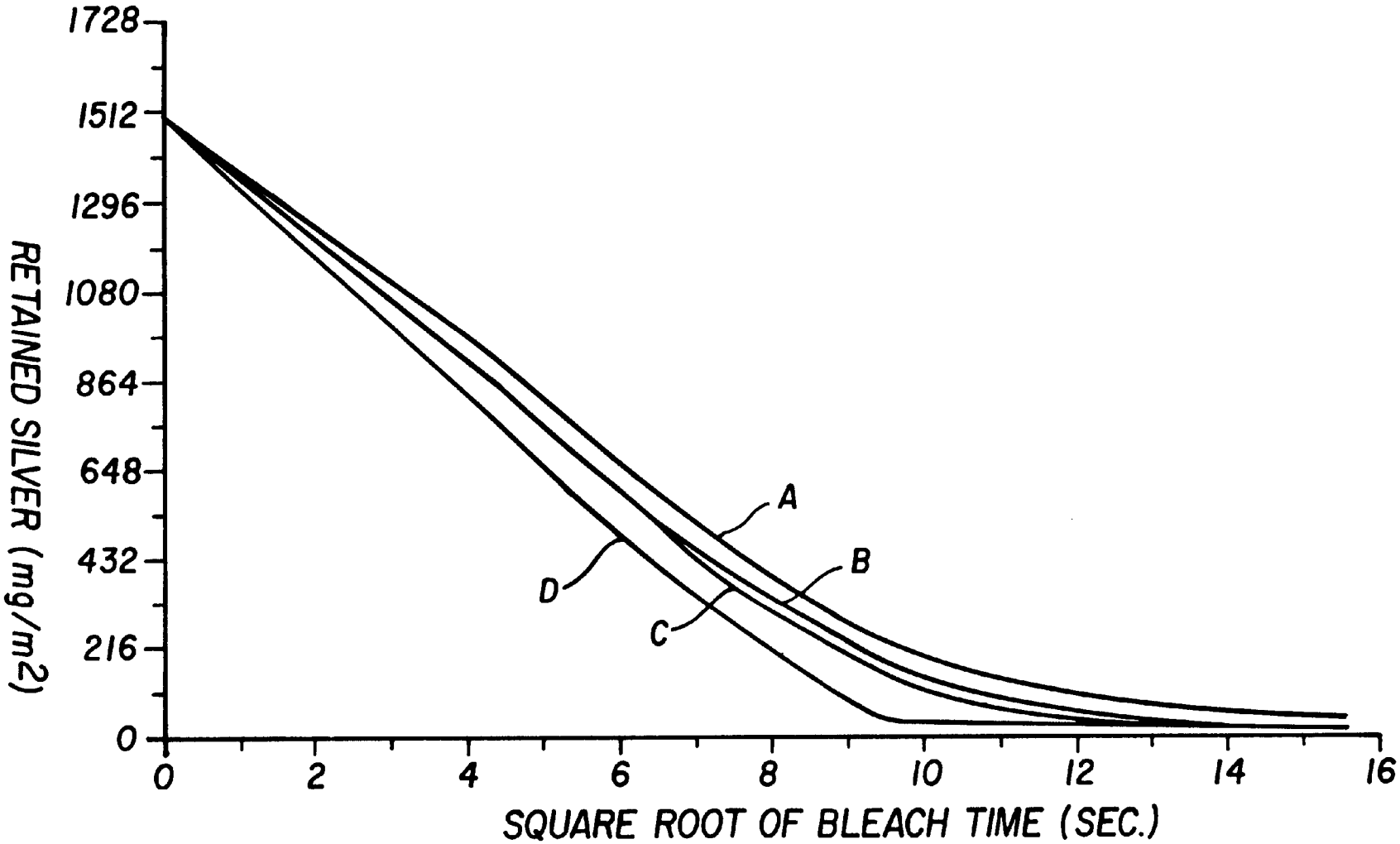
FIG. 7 is a graphical representation of data obtained in Examples 18–20 below, showing the effect on bleaching rate with levels of PDCA in the bleaching compositions.

The data in TABLE VII are also presented graphically in FIG. 7 (retained silver vs. square root of bleaching time) wherein Curve A represents the data from the Control G method, and Curves B, C and D represent the data from Examples 18, 19 and 20, respectively. It is apparent that as the level of bleaching accelerator increased, the rate of silver bleaching was increased as measured by the decreased amount of retained silver metal.

EXAMPLES 21–23

Bleaching of Color Photographic Films with Colorless Cyan Dye Recovery

Samples of commercially available KODAK VERICOLOR II Type L color negative film were imagewise exposed and processed. They were bleached using bleaching compositions having the basic formulation described in Examples 18–20 but with various amounts of the bleaching accelerator, 2,3-pyridinedicarboxylic acid as shown below in TABLE VIII.

Figure 8:
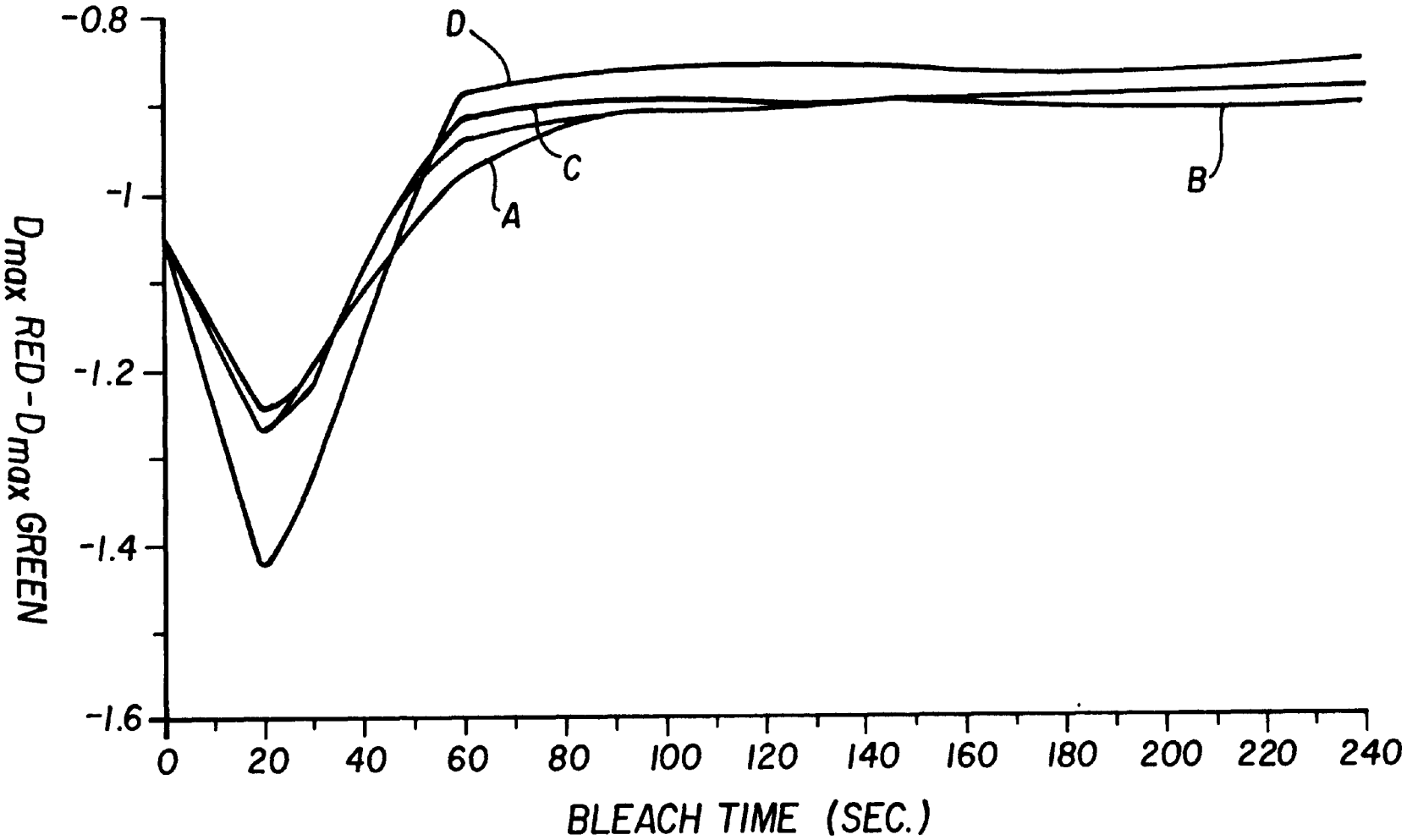
FIG. 8 is a graphical representation of data obtained in Examples 21–23 below, showing the effect on colorless cyan dye recovery with level of PDCA in the bleaching compositions.

The effect of these bleaching compositions on color cyan dye recovery was measured. The results are shown below in TABLE VIII, and in FIG. 8 wherein Curve A represents the data from Control H, and Curves B, C and D represent the data from Examples 21, 22 and 23, respectively. Colorless cyan dye recovery is measured as described above. It is apparent from the data that as the level of PDCA is increased, the time required for (Dmax Red)−(Dmax Green) to become less than −1 was decreased proportionately.

TABLE VIII

| Bleach time (sec) | Control H 0.001 mol/l PDCA:Fe of 0.008:1 | Example 21 0.006 mol/l PDCA:Fe of 0.05:1 | Example 22 0.01 mol/l PDCA:Fe of 0.08:1 | Example 23 0.06 mol/l PDCA:Fe of 0.5:1 |
|---|---|---|---|---|
| 0 | −1.046 | −1.046 | −1.046 | −1.046 |
| 20 | −1.277 | −1.248 | −1.269 | −1.424 |
| 30 | −1.192 | −1.207 | −1.221 | −1.324 |
| 45 | −1.075 | −1.032 | −1.026 | −1.086 |
| 60 | −0.975 | −0.938 | −0.915 | −0.886 |
| 90 | −0.906 | −0.912 | −0.895 | −0.861 |
| 120 | −0.908 | −0.912 | −0.9 | −0.858 |
| 150 | −0.896 | −0.9 | −0.892 | −0.863 |
| 180 | −0.891 | −0.906 | −0.886 | −0.869 |
| 240 | −0.877 | −0.9 | −0.88 | −0.851 |

EXAMPLES 24–26

Accelerated Bleaching with Ferric-PDTA Bleaching Agent

Samples of commercially available KODAK ROYAL GOLD 1000 speed color negative film were imagewise exposed and processed. They were bleached using bleaching compositions having the following basic formulation but with various amounts of the bleaching accelerator, 2,3-pyridinedicarboxylic acid:

| | |
|---|---|
| Ferric-PDTA Complex | 43.5 g/l |
| 2,6-Pyridinedicarboxylic acid | See below |
| Glacial acetic acid buffer | 52.5 g/l |
| Potassium bromide | 30 g/l |
| Total Fe | 0.12 mol/l |
| pH | 4.0 |

For levels of PDCA from 0.001 to 0.06 mol/l, there was no significant increase in bleaching rate using Fe-PDTA as the bleaching agent. It is possible, however, that other amounts of PDCA may provide bleaching rate improvement.

Figure 9:
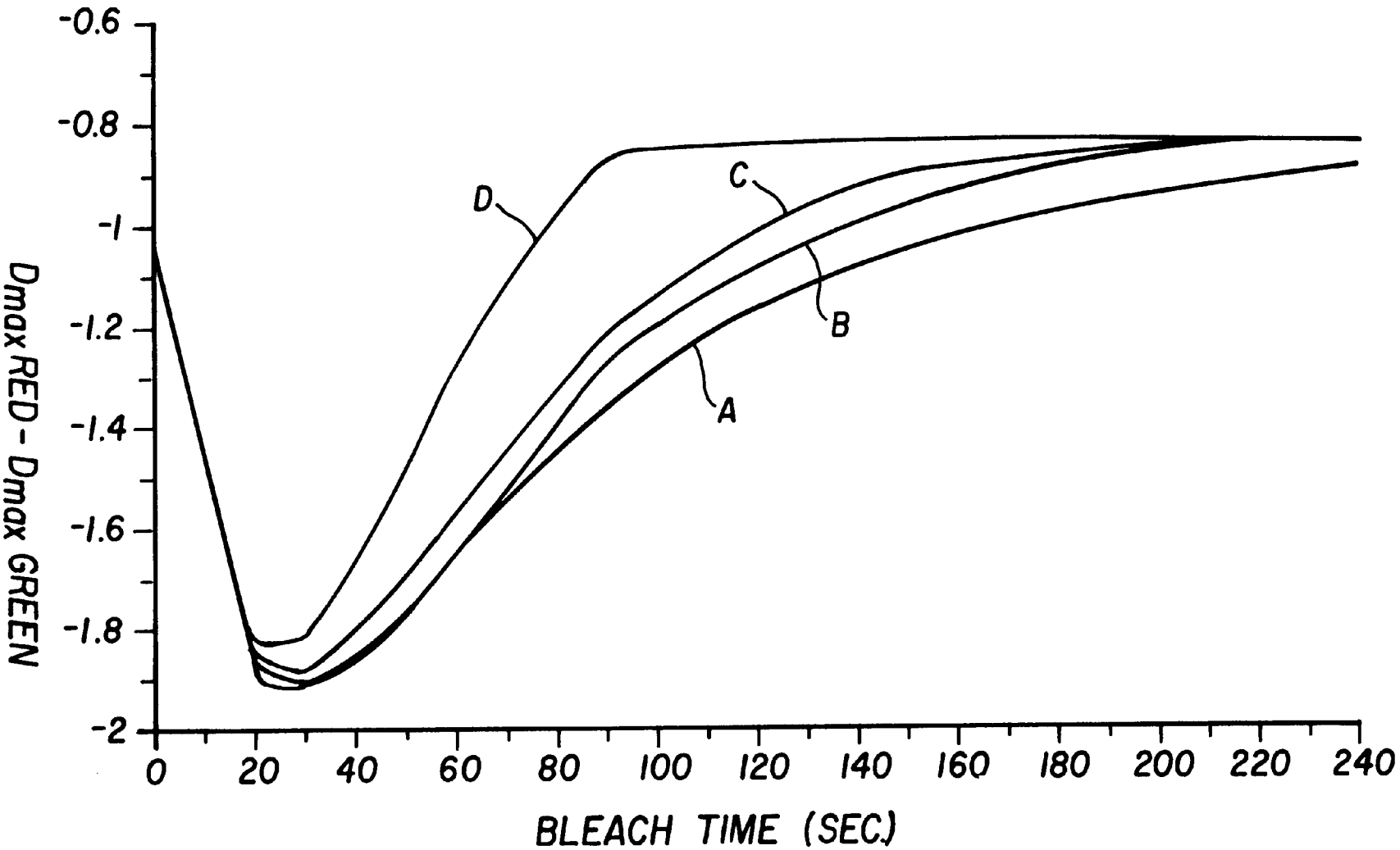
FIG. 9 is a graphical representation of data obtained in Examples 24–26 below, showing the effect on colorless cyan dye recovery with level of PDCA in the bleaching compositions.

However, as noted in TABLE IX below and FIG. 9, the presence of PDCA with Fe-PDTA bleaching agent provided a significant recovery of colorless cyan dye during processing. This was achieved when samples of commercially available KODAK VERICOLOR II Type L color negative film were imagewise exposed and processed. They were then bleached using bleaching compositions having the basic formulation described above but with various amounts of the bleaching accelerator, 2,3-pyridinedicarboxylic acid as shown below in TABLE IX.

The effect of these bleaching compositions on color cyan dye recovery was measured. The results are shown below in TABLE IX, and in FIG. 9 wherein Curve A represents the data from Control I, and Curves B, C and D represent the data from Examples 24, 25 and 26, respectively. Colorless cyan dye recovery is measured as described above. It is apparent from the data that as the level of PDCA is increased, the time required for (Dmax Red)−(Dmax Green) to become less than −1 was significantly decreased proportionately.

TABLE IX

| Bleach time (sec) | Control I 0.001 mol/l PDCA:Fe of 0.008:1 | Example 24 0.006 mol/l PDCA:Fe of 0.05:1 | Example 25 0.01 mol/l PDCA:Fe of 0.08:1 | Example 26 0.06 mol/l PDCA:Fe of 0.5:1 |
|---|---|---|---|---|
| 0 | −1.046 | −1.046 | −1.046 | −1.046 |
| 20 | −1.871 | −1.907 | −1.856 | −1.831 |
| 30 | −1.912 | −1.919 | −1.893 | −1.821 |
| 45 | −1.842 | −1.821 | −1.761 | −1.585 |
| 60 | −1.644 | −1.646 | −1.571 | −1.269 |
| 90 | −1.346 | −1.265 | −1.215 | −0.858 |
| 120 | −1.165 | −1.081 | −1.007 | −0.838 |
| 150 | −1.062 | −0.967 | −0.894 | −0.834 |
| 180 | −0.978 | −0.871 | −0.86 | −0.828 |
| 240 | −0.878 | −0.83 | −0.837 | −0.835 |

The invention has been described in detail with particular reference to preferred embodiments thereof, but it will be understood that variations and modifications can be effected within the spirit and scope of the invention.

What is claimed is:

1. A method of processing comprising:

bleaching or bleach-fixing an imagewise exposed and developed silver halide color photographic element that has at least one layer containing a cyan dye, with a bleaching or bleach-fixing composition to achieve accelerated leuco cyan dye recovery within 180 seconds, said bleaching or bleach-fixing composition comprising a mixture of:

one or more ferric complexes of an aminopolycarboxylic acid that is propylenediaminetetraacetic acid, methyliminodiacetic acid, beta-alaninediacetic acid or ethylenediamine disuccinic acid, the one or more complexes being present as the sole bleaching agent or agents present in an amount to provide ferric ion at from about 0.005 to about 0.5 mol/l, and the molar ratio of said aminopolycarboxylic acid to ferric ion is from about 1:1 to about 5:1, and substantially in an uncomplexed form, an aromatic carboxylic acid that is 2-pyridinecarboxylic acid, 2,3-pyridinedicarboxylic acid or 2,6-pyridinedicarboxylic acid, said molar ratio of the uncomplexed aromatic carboxylic acid to the ferric ion in said bleaching agent being from 0.02:1 to 0.8:1.

2. The method of claim 1 wherein the molar ratio of said uncomplexed aromatic carboxylic acid to the ferric ion in said bleaching agent is from about 0.1:1 to about 0.7:1.

3. The method of claim 1 wherein said uncomplexed aromatic carboxylic acid is 2,6-pyridinedicarboxylic acid.

4. The method of claim 1 wherein said aminopolycarboxylic acid is methyliminodiacetic acid.

5. The method of claim 1 wherein said bleaching or bleach-fixing composition further comprises an organic buffer in an amount of from about 0.1 to about 3 mol/l, said buffer having a pKa of from about 1.5 to about 7, provided said buffer is an acid other than said ferric ion-complexed aminopolycarboxylic acid or said uncomplexed aromatic carboxylic acid.

6. The method of claim 1 wherein said organic buffer is a carboxylic acid.

7. The method of claim 1 wherein said bleaching or bleach-fixing composition further comprises a rehalogenating agent, a fixing agent or both.

8. The method of claim 7 wherein said rehalogenating agent is bromide ion, and said fixing agent is a thiosulfate.

9. The method of claim 1 wherein said photographic element comprises at least one silver halide emulsion having predominantly silver bromide.

10. The method of claim 1 wherein said photographic element comprises at least one silver halide emulsion having predominantly silver chloride, based on total silver.

11. The method of claim 1 wherein said photographic element comprises a 1-naphthol type cyan dye forming color coupler.

12. The method of claim 1 wherein said uncomplexed aromatic carboxylic acid is 2-pyridinecarboxylic acid or 2,6-pyridinecarboxylic acid.

13. The method of claim 12 wherein said uncomplexed aromatic carboxylic acid is 2,6-pyridinedicarboxylic acid.

14. The method of claim 1 wherein ferric ion is present in said bleaching or bleach-fixing composition at a concentration of from about 0.02 to about 0.2 mol/l, and the molar ratio of said aminopolycarboxylic acid to ferric ion is from about 1:1 to about 3.5:1.

15. The method of claim 1 wherein the molar ratio of complexed aromatic carboxylic acid to ferric ion is less than 0.02:1.

* * * * *